US006831615B2

(12) United States Patent
Göttl

(10) Patent No.: US 6,831,615 B2
(45) Date of Patent: Dec. 14, 2004

(54) MULTI-BAND ANTENNA WITH DIELECTRIC BODY IMPROVING HIGHER FREQUENCY PERFORMANCE

(75) Inventor: Maximilian Göttl, Frasdorf (DE)

(73) Assignee: Kathrein-Werke KG, Rosenheim (DE)

( * ) Notice: Subject to any disclaimer, the term of this patent is extended or adjusted under 35 U.S.C. 154(b) by 95 days.

(21) Appl. No.: 10/204,214

(22) PCT Filed: Dec. 13, 2001

(86) PCT No.: PCT/EP01/14711

§ 371 (c)(1),
(2), (4) Date: Aug. 19, 2002

(87) PCT Pub. No.: WO02/50945

PCT Pub. Date: Jun. 27, 2002

(65) Prior Publication Data

US 2003/0011529 A1 Jan. 16, 2003

(51) Int. Cl.[7] ..... H01Q 21/00
(52) U.S. Cl. ..... 343/797; 343/810
(58) Field of Search ..... 343/810, 812, 343/815–818, 797, 873, 795

(56) References Cited

U.S. PATENT DOCUMENTS

| | | | | |
|---|---|---|---|---|
| 2,551,586 A | * | 5/1951 | Dobler et al. | 343/836 |
| 3,475,758 A | | 10/1969 | Vito | 343/797 |
| 4,434,425 A | | 2/1984 | Barbano | 343/797 |
| 5,173,715 A | | 12/1992 | Rodal et al. | 343/795 |
| 5,481,272 A | | 1/1996 | Yarsunas | 343/797 |
| 5,629,713 A | | 5/1997 | Mailandt et al. | 343/808 |
| 5,757,246 A | | 5/1998 | Johnson | |
| 6,023,244 A | | 2/2000 | Snygg et al. | 343/700 MS |
| 6,025,812 A | | 2/2000 | Gabriel et al. | 343/797 |
| 6,069,586 A | | 5/2000 | Karlsson et al. | |
| 6,069,590 A | | 5/2000 | Thompson et al. | |
| 6,091,365 A | | 7/2000 | Derneryd et al. | |
| 6,333,720 B1 | | 12/2001 | Göttl et al. | 343/810 |

FOREIGN PATENT DOCUMENTS

| | | |
|---|---|---|
| DE | 10 11 010 | 6/1957 |
| DE | 11 60 513 | 1/1964 |
| DE | 43 02 905 | 3/1994 |
| DE | 198 21 223 A1 | 11/1998 |
| DE | 199 01 179 A1 | 7/1999 |
| DE | 198 23 749 A1 | 12/1999 |
| DE | 196 27 015 C2 | 7/2000 |
| EP | 0 362 079 | 4/1990 |
| EP | 0 431 764 | 6/1991 |

(List continued on next page.)

OTHER PUBLICATIONS

Beckmann, C. et al.: "Antenna Systems for Polarization Diversity," Microwave Journal, Bd. 40, Nr. 5, 1 (May 1997).
Heilmann, A.: Antennen, Sweiter Teil, Wien/Zurich, S. 47–50 (1970).

(List continued on next page.)

*Primary Examiner*—Michael C. Wimer
(74) *Attorney, Agent, or Firm*—Nixon & Vanderhye P.C.

(57) ABSTRACT

An improved antenna includes a dielectric body arranged entirely or mostly (e.g., with more than 40% such as more than 50% or 60% of its volume and/or of its weight) underneath antenna radiating elements provided for lower frequency operation; and entirely, or mostly (e.g., 40%, 50% or 60% of its volume and/or of its weight) above antenna radiating elements provided for upper frequency operation.

24 Claims, 6 Drawing Sheets

FOREIGN PATENT DOCUMENTS

| | | |
|---|---|---|
| EP | 0 685 900 | 12/1995 |
| WO | WO97/22159 | 6/1997 |
| WO | WO98/01923 | 1/1998 |
| WO | WO 98/36472 | 8/1998 |
| WO | WO 98/37592 | 8/1998 |
| WO | 98/48480 | 10/1998 |
| WO | WO 99/17403 | 4/1999 |
| WO | 99/59223 | 11/1999 |

OTHER PUBLICATIONS

Zehentner, H.: Neue Sendeantenne fur terrestrisches Fernsehen . . . , Berlin, Offenbach, S. 357–362 (1994).

S. Maci and G. Biffi Gentili: "Dual–Frequency Patch Antennas," IEEE Antennas and Propagation Magazine, vol. 39, No. 6, (Dec. 1997).

* cited by examiner

MULTI-BAND ANTENNA WITH DIELECTRIC BODY IMPROVING HIGHER FREQUENCY PERFORMANCE

This application is the US national phase of international application PCT/EP01/14711 filed 13 Dec. 2001, which designated the US.

FIELD

The technology described herein relates to antennas, and in particular to radio antennas for communicating with mobile radios.

BACKGROUND AND SUMMARY

Mobile radio antennas for mobile radio base stations are generally provided with a number of radiating element arrangements, located one above the other in the vertical direction, in front of a reflector plane. These radiating element arrangements may comprise a large number of dipole radiating elements. Such dipole elements may for example be in the form of crucible dipoles, a dipole square, or other radiating element types which have a dipole structure. Antennas in the form of so-called patch radiating elements are also known.

As is known, mobile radios can operate on various mobile radio frequency bands. For example, the 900 MHz frequency band is generally used for the so-called GSM 900 network; and the 1800 MHz or the 1900 MHz frequency band are used for the so-called GSM 1800 network in the USA and in a large number of other countries. A frequency band around 2000 MHz has been allocated for the next mobile radio generation, namely the UMTS network.

It is thus usual to design mobile radio antennas as at least dual-band antennas. Triple-band antennas may also be desirable (for example, for the 900 MHz, for the 1800 and 1900 MHz or, for example, for the 2000 MHz band).

Furthermore, such mobile antennas are preferably designed as dual-polarized antennas for operation with polarizations of +45° and −45°. It is also usual for such antennas to be protected against weather influences by a plastic shroud. This so-called radome has to achieve objects which are primarily mechanical and surrounds all the radiating antenna parts to the same extent. An antenna such as this for operation in at least two frequency bands that are offset with respect to one another has been disclosed, by way of example, in DE 198 23 749 A1 corresponding to U.S. Pat. No. 6,333,720 owned by the present assignee.

One problem that frequently arises with such two-band or multiband antennas in general is that the 3 dB beam widths of the polar diagram in the azimuth direction may differ widely for the different frequency ranges and/or bands. A further problem that often occurs with two-band or multiband antennas is that cross-polar components can lead to deterioration in the polar diagram characteristic. The VSWR ratio and/or the decoupling may also be disadvantageously influenced.

Many known antennas in the prior art are designed for only a single frequency band—that is, they can receive and transmit in only one frequency band. These may be linear-polarized or dual-polarized antennas for transmission in only one frequency band. Antennas such as these which operate in only one frequency band are disclosed, for example, in the publications DE 199 01 179 A1, DE 198 21 223 A1, DE 196 27 015 C2, U.S. Pat. No. 6,069,590 A and U.S. Pat. No. 6,069,586 A. These prior publications generally deal with different types of problems including decoupling two polarizations in the same frequency band. Electrically conductive parts are generally used for this purpose, to produce decoupling elements that radiate parasitically.

Exemplary non-limiting technology described herein provides a considerable improvement (irrespective of whether the antenna is operated with only one polarization or with a number of polarizations), at least for operation in two frequency bands, with regard to the 3 dB beam width and/or with regard to the suppression of the cross-polar component and/or of the VSWR ratio and/or with regard to decoupling and increasing the bandwidth.

The advantages mentioned above are obtained not just individually but also cumulatively by exemplary illustrative technology described herein Providing a dielectric body for a mobile radio antenna is known per se, which dielectric body has at least one extent direction parallel to the reflector plane that is larger than its extent component which runs at right angles to the reflector plane. However, the dielectric body according to exemplary non-limiting implementations herein is preferably in the form of a plate. In particular, in a plan view, it may be in the form of an n-sided polygon, and may extend, for example, above a dipole radiating element arrangement, for example a cruciform dipole, a dipole square or a patch radiating element, with the extent position being located above the corresponding radiating elements for a higher frequency band and below the radiating elements at least for the lowest frequency band.

Furthermore, the dielectric body according to exemplary non-limiting implementations, (which is also referred to as a dielectric tuning plate in places in the following text) is symmetrical when seen in a plan view, and may have at least sections which are designed to be and are arranged symmetrically with respect to an individual radiating element arrangement.

Furthermore, it has also been found to be advantageous, in addition or alternatively, to arrange corresponding dielectric bodies at a distance in front of the reflector plate, between two radiating element arrangements which are generally arranged located one above the other in the vertical direction in front of a vertical reflector plane.

The dielectric bodies according to exemplary non-limiting implementations may, for example, be composed of suitable plastic material, for example polystyrene, glass fiber reinforced plastic (GFRP), etc.

A material whose dielectric does not have a high loss factor is preferably used for the dielectric body in exemplary illustrative implementations.

An exemplary non-limiting implementation has a particularly advantageous effect, for example, in the frequency bands from 800 to 1000 MHz and from 1700 to 2200 MHz.

The dielectric body is preferably in the form of a plate and extends in a parallel plane in front of the reflector. However, it may also be provided with attachment devices or stand feet (in general spacers etc.) which are composed of the same material, in order to arrange it at a predetermined distance, which has been found to be advantageous, in front of the reflector plate. The extent height is preferably less than $\lambda/2$.

The antenna according to exemplary non-limiting implementations makes it possible to achieve a considerable reduction in the frequency dependency of the 3 dB beam width. Mobile radio antennas are frequently set such that they have a 3 dB beam width of 65°. This 65° 3 dB beam width can, however, normally not be set completely identically for the at least two frequency bands, particularly if these are very broad bands. A discrepancy with regard to the at least two intended frequency bands of, for example, 65°±10° (or at least ±7°) is typical in the prior art. According to exemplary non-limiting implementations described herein, this discrepancy can now be improved to 65°±5° (or even only ±4° or less).

As is known, antennas for use in communicating with mobile radios, are frequently adjusted such that they each emit in a horizontal 120° sector angle. This is also referred to as a sector. Three sectors are thus formed per stationary antenna mast. A corresponding mobile radio antenna thus transmits at an angle of +60° or −60° at the sector boundaries, with the suppression of the cross-polar components, especially at the sector boundaries according to the prior art, having poor values, particularly in the case of broadband antennas. The antenna according to exemplary non-limiting implementations herein using the dielectric tuning body can allow a ratio of 10 dB or even better to be achieved, even at the sector boundaries at ±60°, with regard to the suppression of the cross-polar component.

If—although this is not essential—cross-polarizing radiating elements are used in a multiband (e.g., at least dual band) antenna arrangement, then the decoupling can likewise be improved considerably. The required decoupling is in the order of magnitude of more than 30 dB. This can be a major problem, particularly in the case of broadband antennas or antennas with an electrically adjustable notch. The antenna according to exemplary non-limiting implementations herein considerably exceeds this value—in particular even when the antennas have a broad bandwidth and are also electrically adjustable.

A further positive factor is bandwidth broadening, especially for the higher frequencies.

Advantages mentioned above with the dielectric body according to exemplary non-limiting implementations have a positive effect especially for higher frequency bands, with the measures having virtually no influence on lower or lowest intended frequency bands.

BRIEF DESCRIPTION OF THE DRAWINGS

These and other exemplary illustrative non-limiting features and advantages will be better and more completely understood by referring to the following detailed description in conjunction with the drawings, of which.

DETAILED DESCRIPTION OF EXAMPLE NON-LIMITING ILLUSTRATIVE IMPLEMENTATIONS

Figure 1:
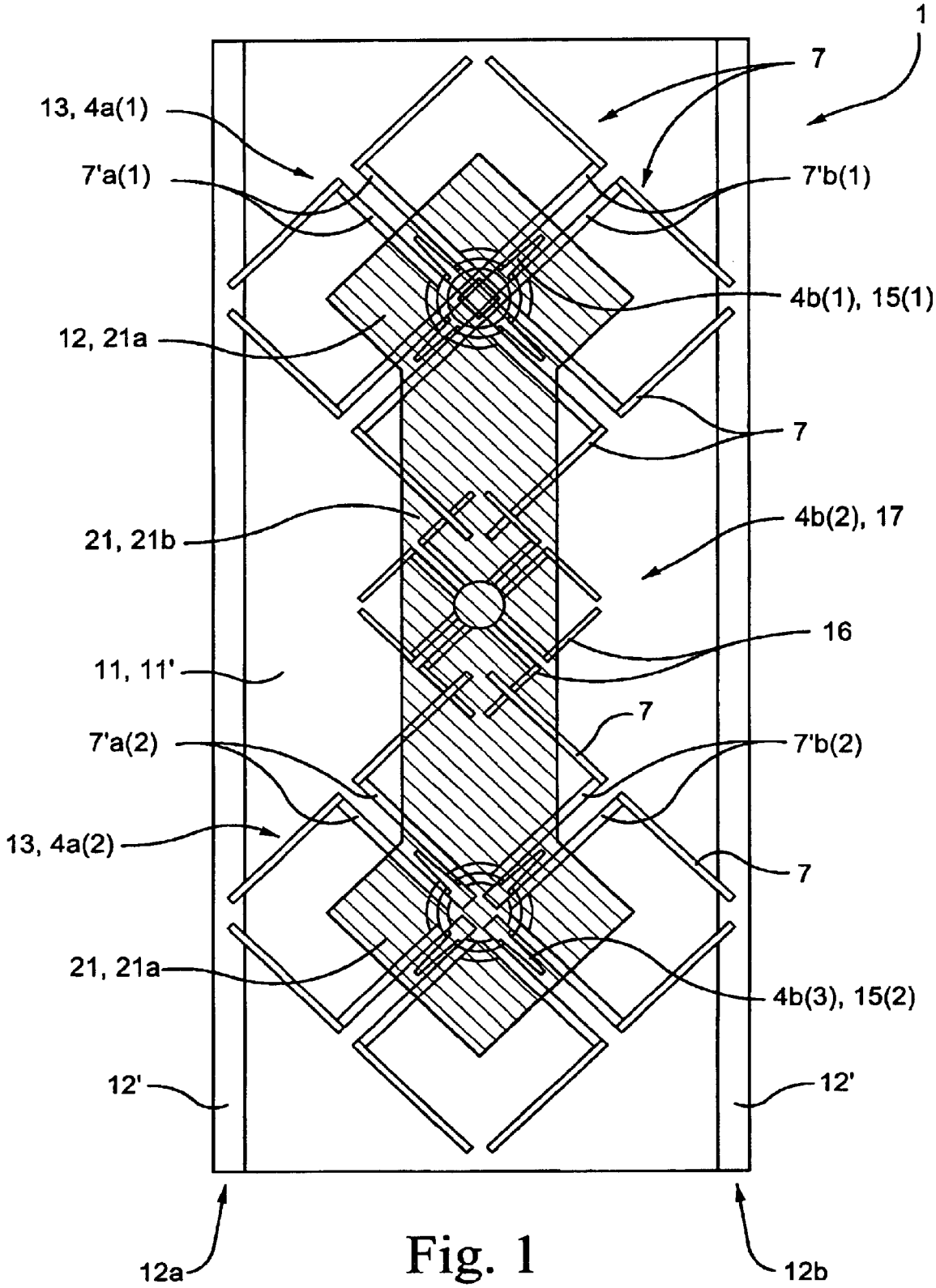
FIG. 1 shows a schematic plan view of a first exemplary embodiment of an exemplary non-limiting illustrative antenna for the mobile radio field, with a number of radiating elements and a dielectric body.
Figure 2:
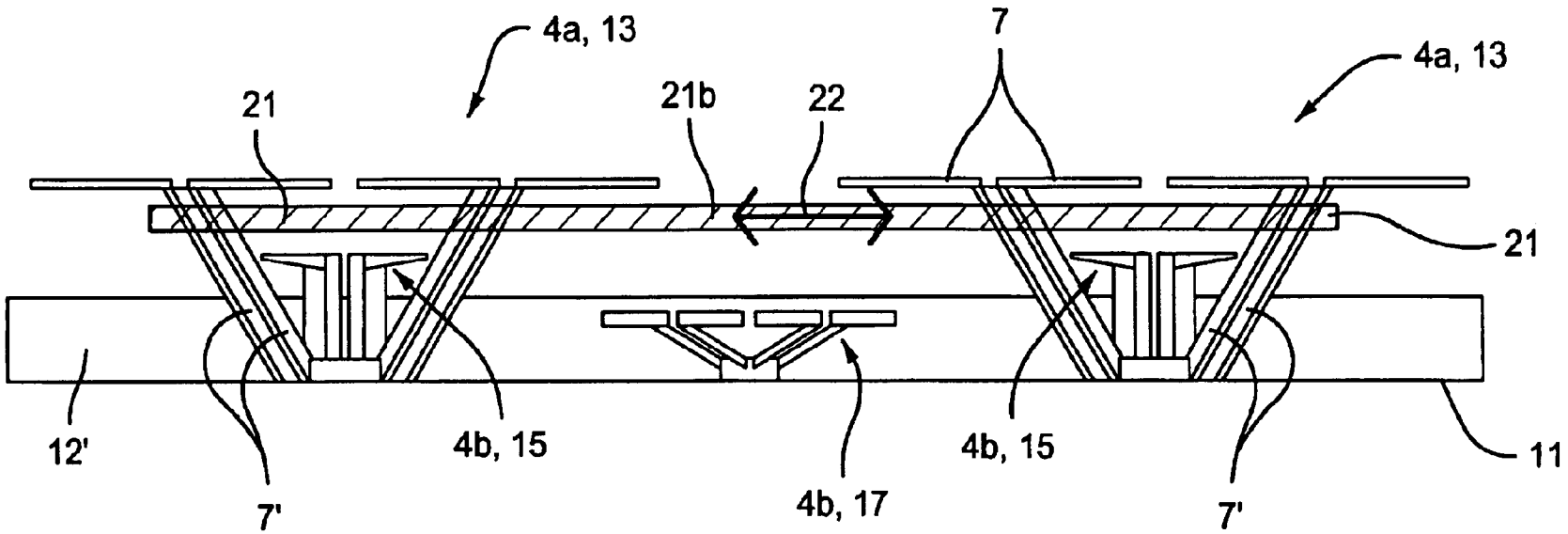
FIG. 2 shows a schematic transverse face view at right angles to the vertical longitudinal extent of the exemplary non-limiting illustrative antenna shown in FIG. 1.
Figure 3:
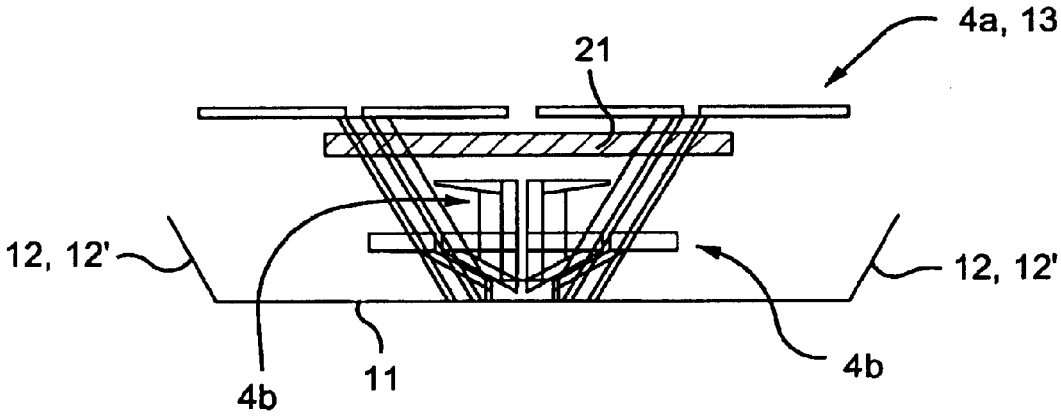
FIG. 3 shows a vertical end face view of the exemplary illustrative non-limiting antenna shown in FIGS. 1 and 2.

In a first exemplary illustrative non-limiting embodiment as shown in FIGS. 1 to 3, the antenna 1 has five individual radiating:

two first radiating elements 4*a*(1), 4*a*(2), which are located offset with respect to one another in the vertical direction, for a first, lower frequency band, and three second radiating elements 4*b*(1), 4*b*(2), 4*b*(3), which are offset in the vertical direction, for a second, higher frequency band.

The first radiating elements 4*a*(1), 4*a*(2) are dipole radiating elements 7 in the exemplary implementation arranged in the form of a dipole square 13. Elements 4*a*(1), 4*a*(2) are held via so-called balancing devices 7', at least some of which run to a common center point. Elements 4*a*(1), 4*a*(2) are attached to an electrically conductive reflector 11.

The second radiating elements 4*b*(1), 4*b*(3) are arranged within first radiating elements 4*a*(1), 4*a*(2) respectively, and are formed in the illustrated exemplary embodiment on the basis of cruciform dipoles 15(1), 15(2) with two mutually perpendicular dipoles.

The central radiating element device 4*b*(2), which is provided between the first radiating elements 4*a*(1), 4*a*(2) and likewise belongs to the group of second radiating elements 4*b*, in this exemplary embodiment likewise comprises a dipole square 17 which is formed from four dipoles 16 and which, in principle, is comparable to and similar to the large dipole squares of the first radiating elements 4*a*(1).

The various radiating elements 4*a*, 4*b* which have been mentioned above are arranged in front of the vertically aligned reflector 11. The reflector 11 may be formed, for example, from a reflector plate 11', with two edge sections 12', placed on vertical sides 12*a*, 12*b*, from the reflector plane, in the emission direction.

As can be seen from the illustrations in FIGS. 1 to 3, a dielectric body 21 is provided to improve various antenna characteristics. Dielectric body 21 in the illustrated exemplary embodiment is in the form of a plate and extends at least essentially parallel to the reflector 11 plane. Body 21 is preferably located at a distance in front of the reflector 11 plane which is less than $\lambda/2$ of the highest transmitted frequency band, or is less than $\lambda/2$ of the associated mid-frequency of the highest frequency band. The thickness of the dielectric body 21 may be chosen to be different, within wide limits. Good values are between 2% and 30%. One exemplary illustrative arrangement provides a dielectric body 21 thickness of between 5% and 10% of the distance between the individual first radiating elements 4*a*and the associated reflector 11.

As can be seen in particular from the plan view shown in FIG. 1 in comparison to the two side views shown in FIGS. 2 and 3, the dielectric body 21 in illustrative exemplary non-limiting arrangements has at least one extent component 22 which runs parallel to the plane of the reflector 11. Dielectric component 22 in this exemplary arrangement is larger than:

(a) its thickness and/or (b) the distance between its center plane and the plane of the reflector 11, and/or (c) the distance between the radiating elements 4*b*, 15 of the radiating elements which are provided for the upper frequency band and the associated plane of the reflector 11.

It has been found to be advantageous for the dielectric body 21 to be arranged entirely or at least partially at a distance in front of the reflector 11—for example, above the radiating element arrangement which is intended for the upper frequency band. It has likewise been found to be advantageous for the dielectric body 21 to be arranged entirely or at least partially underneath the radiating element arrangement which is intended for the lower frequency band. Both the conditions mentioned above should, in exemplary illustrative implementations, preferably be satisfied at the same time. The effect is particularly advantageous if the dielectric body 21 is (1) entirely, or with at least one section, located above the radiating element arrangement provided for the upper frequency band, while (2) at the same time being located underneath the radiating element arrangement which is provided for the lower frequency band, and (3) also extends entirely or essentially parallel to the reflector 11. If the dielectric body 21 is not located entirely above the radiating elements 4*b* which are provided for the upper frequency band and is not located entirely underneath the radiating elements 4*a* which are intended for the lower frequency band, then the effect is particularly advantageous if, with respect to its overall volume and/or its overall weight, the dielectric body 21 is located at least to an adequate extent in this position (for example with more than at least 30%, 40%, 50%, or, in particular, with more than 60%, 70%, 80% or 90% of its entire weight and/or volume located in the stated region).

The illustrated exemplary embodiments also provide, in the projection at right angles to the reflector 11 located underneath it, the at least one dielectric body 21 being smaller than the reflector plate. In fact, the dielectric body 21 may be of a size which, in the end, corresponds to a size that is larger than the reflector 11.

In the illustrated exemplary embodiment, a first section of the dielectric body 21 is arranged symmetrically within the first radiating elements 4*a* and thus above the second radiating elements 4*b* which are located in it. The dielectric body may be in a square shape in the illustrated exemplary embodiment since the first radiating elements 4*a* are formed from a dipole square.

The dielectric body 21 that is formed in this way, that is to say the dielectric tuning plate 21, is provided in the illustrated exemplary embodiment with a central vertical section 21*b*. Vertical section 21*b* connects the sections 21*a* in the region of the dipole squares 13 of the two first radiating element arrangements 4*a*, which are offset with respect to one another in the illustrated exemplary embodiment. Thus, in the illustrated exemplary embodiment, the dielectric tuning plate 21 which is formed in this way is integral. However, it could also be composed of a number of parts which correspond at least approximately to the shape shown in FIG. 1. For example, two sections 21*a* may form a square and, corresponding to the dipole square 13, are each arranged concentrically in respect thereto, parallel to the reflector plane. The longer connecting section 21*b* could then be provided such that it runs between these two sections 21*a*.

Particularly for the higher frequencies, for example from 1700 to 2200 MHz (for example 2170 MHz), this allows the 3 dB beam width, the value for the suppression of the cross-polar component, the decoupling and also the increase in bandwidth to be improved in an advantageous manner. Virtually no disadvantageous influences can be found for the lower frequency band or the low frequency bands.

As can be seen indirectly from the drawings, the dielectric body is preferably mechanically attached to the radiating elements, for example at their balancing devices.

Figure 6:
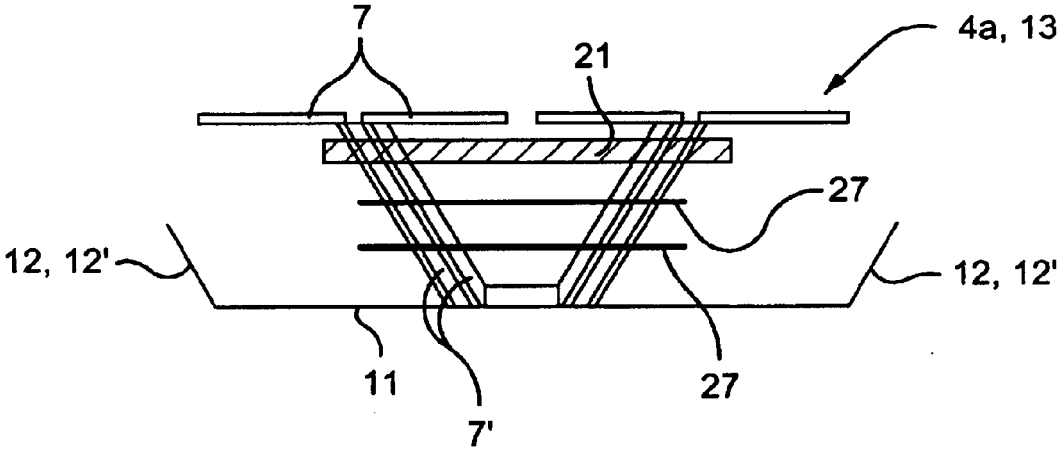
FIG. 6 shows an end face view of the exemplary antenna shown in FIGS. 4 and 5.
Figure 4:
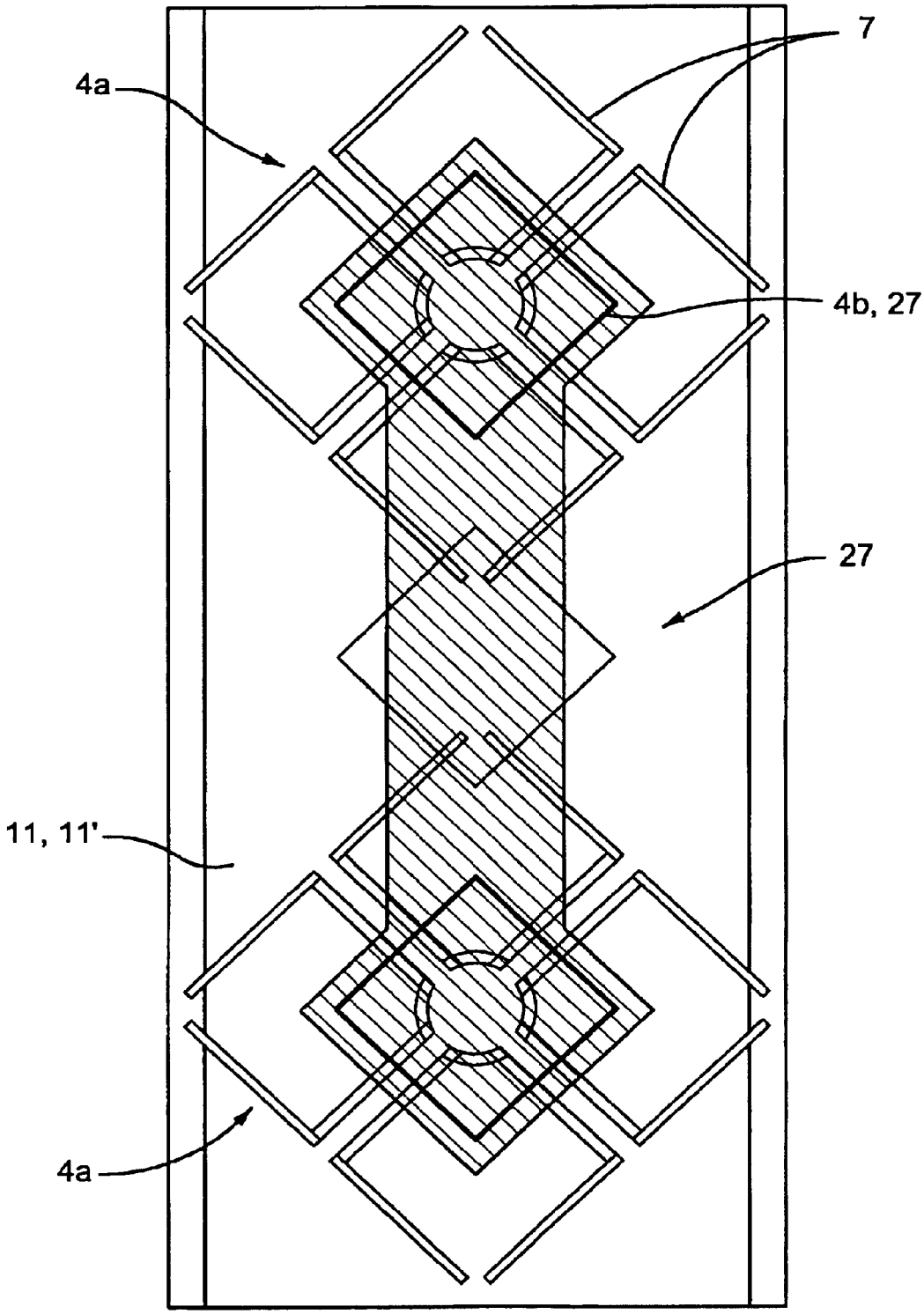
FIG. 4 shows a plan view of an exemplary embodiment modified from that in FIG. 1.
Figure 5:
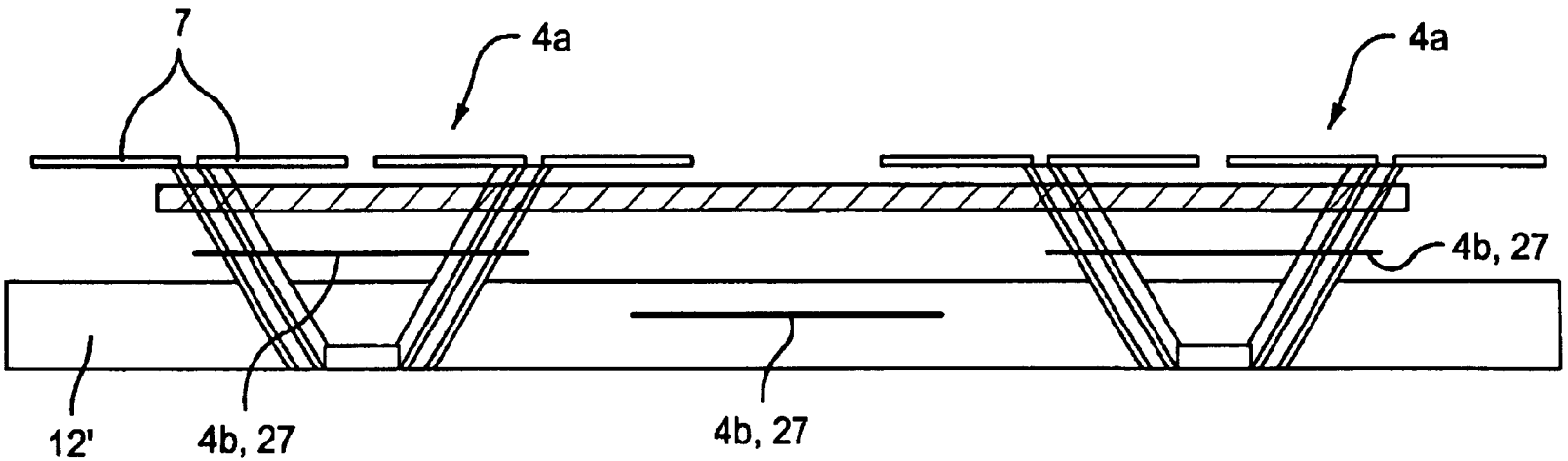
FIG. 5 shows a corresponding transverse face view of the exemplary antenna shown in FIG. 4.

The exemplary illustrative non-limiting embodiment shown in FIGS. 4 to 6 differs from that shown in FIGS. 1 to 3 in that patch radiating elements 27 are used for the second radiating elements 4*b* (instead of the cruciform radiating elements 15). Flat radiating elements, for example in the form of a square radiating element, are aligned at a suitable distance in front of the reflector 11, centrally and symmetrically, with the same polarization alignment with respect to the first radiating elements 4*a*. A further patch radiating element 27 is also provided, located in the center, between the two patch radiating elements 27, which are each provided in the first radiating element 4*a*. This further patch radiating element 27 may be located at a different height, as can be seen in particular from the longitudinal face illustration shown in FIG. 5, and from the end face view shown in FIG. 6. The rest of the first dipole radiating elements 4*a*, which are in the form of a dipole square, could be replaced by patch radiating elements, so that the overall antenna is in the form of a patch antenna.

With this patch antenna as well, a corresponding dielectric body 21 is provided as the dielectric tuning element or as the dielectric tuning plate 21, as can be seen from the illustrations.

The dielectric body 21 can be anchored and held in a suitable way for example on the balancing devices 7' on the individual radiating elements. It can also be provided with stand feet which are likewise, for example, formed from dielectric or from metal(i.e., they may also be conductive).

Figure 7:
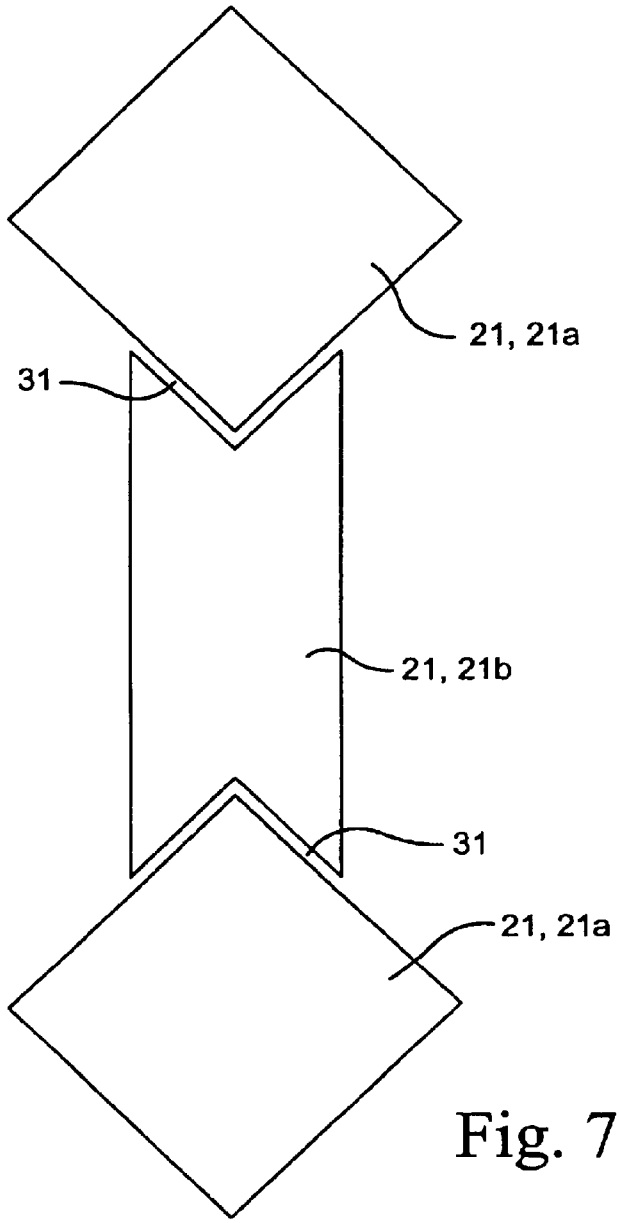
FIG. 7 shows a schematic plan view of an exemplary dielectric body which is composed of a number of parts.

The dielectric body 21 need not be integral. It may also be formed from a number of isolated separate subsections, which are then effectively joined together to form a desired shape. In this case it is irrelevant if the individual elements from which the dielectric body 21 can be formed do not lie completely flat together in the fitting direction but, for example in a schematic plan view shown in FIG. 7, are located such that spacing gaps 31 remain between the individual elements.

Figure 8:
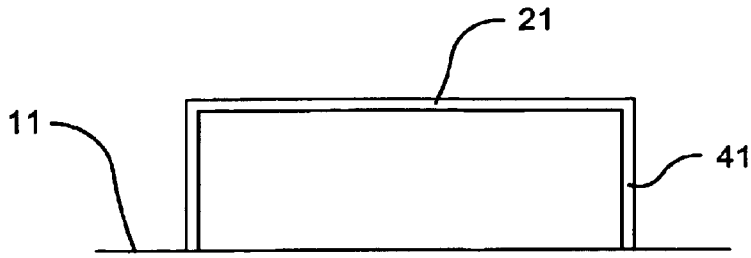
FIG. 8 shows a schematic cross-sectional illustration of an exemplary dielectric body provided with spacers or feet.

FIG. 8 shows schematically with respect to a cross section through the element 21, how the dielectric tuning element or the dielectric body can also be provided with spacers for attachment to the reflector 21. The spacing elements 41 may be separate spacers or may be composed of the same material as the dielectric body 21 itself. Where and in what size the spacers are formed can be varied as required within wide limits.

The shape may also differ within wide limits. The shape may in this case be changed such that the desired advantageous antenna characteristics can be produced and implemented.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

What is claimed is:

1. An antenna, for operation in at least two frequency bands, comprising:

a reflector, a protective shroud comprising nonconductive material, plural antenna radiating elements disposed between the protective shroud and the reflector, said plural antenna radiating elements including at least one lower frequency band radiating element and at least one upper frequency band radiating element, the lower frequency band radiating element being disposed at a first distance from the reflector, the higher frequency band radiating element being disposed at a second distance, from the reflector, said second distance being less than said first distance, a region being defined between the first distance and the second distance, and at least one dielectric body which does not form the protective shroud, more than 40% of the volume and/or more than 40% of the weight, of the at least one dielectric body being disposed within said region between the upper frequency radiating element and the lower frequency radiating element.

2. The antenna of claim 1, wherein, when viewed in a projection at right angles to the reflector, the at least one dielectric body is smaller than the reflector which is located underneath it.

3. The antenna of claim 1, wherein, when viewed in a projection at right angles to the reflector, the at least one dielectric body is of precisely the same size as the reflector which is located underneath it.

4. The antenna of claim 1, wherein the dielectric body is mechanically attached to at least some of the radiating elements.

5. The antenna of claim 1, wherein, in a plan view, the at least one dielectric body is in the form of an n-sided polygon.

6. The antenna of claim 1, wherein the at least one dielectric body is at least essentially in the form of a plate.

7. The antenna of claim 1, wherein at least a portion of the dielectric body, is symmetrical with respect to a predetermined radiating element.

8. The antenna of claim 1, wherein the dielectric body is arranged such that more than 50% of said dielectric body is disposed at a distance of less than $\lambda/2$ from the plane of the reflector with respect to the higher frequency band.

9. The antenna of claim 1, wherein at least the major parts of the dielectric body extend in a further region which is located above the radiating element for the highest frequency band.

10. The antenna of claim 1, wherein the dielectric body comprises at least one material selected from the group consisting of plastic, polystyrene, ABS and glass fiber reinforced plastic.

11. The antenna of claim 1, wherein the dielectric body comprises a material having a low dielectric loss factor in the order of magnitude of $10^{-3}$ or less.

12. The antenna of claim 1, wherein the upper frequency band comprises one of: a 900 MHz band, a 1800 MHz band, and a 2000 MHz band.

13. The antenna of claim 1, wherein:

more than 50% of the volume, and/or more than 50% of the weight, of the at least one dielectric body is arranged in a further region between the reflector and the first distance or the first distance range of the lower frequency band radiating elements, and more than 50% of the volume and/or more than 50% of the weight of the at least one dielectric body is arranged, as seen from the reflector, at more than the second distance or the second distance range for the upper frequency band radiating elements.

14. The antenna of claim 1, characterized by the following further features:

more than 70% of the volume, and/or more than 70% of the weight, of the at least one dielectric body is arranged in a further region between the reflector and the first distance or the first distance range of the lower frequency band radiating elements, and more than 70% of the volume and/or more than 70% of the weight of the at least one dielectric body is arranged, as seen from the reflector, at more than the second distance or the second distance range for the upper frequency band radiating elements.

15. An antenna having a reflector, the reflector defining a plane, the antenna comprising:

a protective shroud comprising nonconductive material, plural radiating elements disposed between the protective shroud and the reflector, said plural radiating elements comprising at least a lower frequency band radiating element and at least an upper frequency band radiating element, the radiating elements for the lower frequency band being disposed at a first distance range from the reflector, the radiating elements for the higher frequency band being disposed a second distance range from the reflector, said second distance range being closer to said reflector than said first distance range, a distance area being defined parallel to the reflector between the upper frequency radiating elements and the lower frequency radiating elements, at least one dielectric body which does not form the protective shroud at least part of the dielectric body being disposed in the distance area which extends parallel to the reflector and is defined by the radiating elements for the lower frequency band and by the radiating elements for the upper frequency band, the dielectric body comprising an extent component which runs toward the plane of the reflector and is longer than its extent direction which runs at right angles to the plane of the reflector, and/or than its distance from the plane of the reflector.

16. An antenna of the type including a reflector, the antenna comprising:

a protective shroud composed of nonconductive material, radiating elements arranged between the protective shroud and the reflector, said radiating elements including lower frequency band radiating elements and upper frequency band radiating elements, the radiating elements for the lower frequency band being arranged at a first distance, or in a first distance range, in front of the reflector, the radiating elements for the higher frequency band being arranged at a second distance, or in a second distance range, in front of the reflector, said second distance or second distance range being closer to said reflector than said first distance or first distance range, at least one of said higher frequency band radiating elements and said lower frequency band radiating elements being arranged in a dipole square, at least one dielectric body which does not form the protective shroud, said dielectric body being arranged in a vertical plan view of the reflector such, that the dielectric body is located at the same level as and within the dipole square, the dielectric body having a surface area defined by a right-angle projection onto the plane of the reflector, the size of said surface area being larger than the square of the linear distance which is obtained from the distance between the plane of the reflector and at least one of:

(1) the dielectric body, (2) the distance between the plane of the reflector and a center plane which runs through the dielectric body, and (3) the distance between the plane of the reflector and the outer boundary surface of the dielectric body, facing away from the reflector plane.

17. An antenna comprising:

a protective shroud composed of nonconductive material, plural radiating elements arranged underneath the protective shroud and in front of the reflector, said plural radiating elements including lower frequency band radiating elements and upper frequency band radiating elements, the radiating elements for the lower frequency band being disposed at a first distance, or in a first distance range, in front of the reflector, the radiating elements for the higher frequency band being arranged at a second distance, or in a second distance range, in front of the reflector, the higher frequency band radiating elements being closer to the reflector than the lower frequency band radiating elements, and at least one dielectric body which does not form the protective shroud at least part of the dielectric body extending above parts of the radiating elements at a distance in front of the reflector, the dielectric body extending parallel to the reflector, and when viewed in a vertical plan view of the reflector, having a flat extent which is greater than the flat extent, attachment elements being coupled to the dielectric body, said attachment elements running toward the reflector.

18. A plural-band antenna comprising:

a reflector;

at least one lower frequency band radiating element disposed a first distance from the reflector, at least one upper frequency band radiating element disposed a second distance from the reflector, wherein said first distance is greater than said second distance; and a dielectric body at least partially disposed between said at least one upper frequency band radiating element and said at least one lower frequency band radiating element, said dielectric body improving upper frequency band antenna performance characteristics substantially without degrading lower frequency band antenna performance.

19. The antenna of claim 18 wherein said reflector presents a substantially planar surface, and said dielectric body has a substantially planar extent that is substantially parallel to said substantially planar reflector surface.

20. The plural-band antenna of claim 18 wherein said dielectric body has a mass and a volume, and more than 50% of at least one of said dielectric body mass and said dielectric body volume is disposed between said first and second distances.

21. The plural-band antenna of claim 18 wherein at least one of said lower frequency band radiating element and said upper frequency band radiating element comprises a dipole radiating element.

22. The plural-band antenna of claim 18 wherein at least one of said lower frequency band radiating element and said upper frequency band radiating element comprises a patch radiating element.

23. The plural-band antenna of claim 18 wherein at least one of said lower frequency band radiating element and said upper frequency band radiating element comprises a cruciform radiating element.

24. The plural-band antenna of claim 18 wherein at least one of said lower frequency band radiating element and said upper frequency band radiating element comprises a dipole square defining an area, and said dielectric body is disposed at least in part within the area defined by said dipole square.

* * * * *